US007266985B2

(12) United States Patent
Bello

(10) Patent No.: US 7,266,985 B2
(45) Date of Patent: Sep. 11, 2007

(54) METHOD OF PROCESSING METAL PARTS BY BLANKING

(75) Inventor: Remo Bello, Saccol di Valdobbiadene (IT)

(73) Assignee: Pegasus S.r.l., Valdobbiadene TV (IT)

( * ) Notice: Subject to any disclaimer, the term of this patent is extended or adjusted under 35 U.S.C. 154(b) by 118 days.

(21) Appl. No.: 10/532,187

(22) PCT Filed: Oct. 13, 2003

(86) PCT No.: PCT/IT03/00620

§ 371 (c)(1),
(2), (4) Date: Oct. 6, 2005

(87) PCT Pub. No.: WO2004/037461

PCT Pub. Date: May 6, 2004

(65) Prior Publication Data

US 2006/0053858 A1 Mar. 16, 2006

(30) Foreign Application Priority Data

Oct. 22, 2002 (IT) ..... PD2002A0274

(51) Int. Cl.
*B21D 28/02* (2006.01)

(52) U.S. Cl. ..... 72/334; 83/50; 29/20

(58) Field of Classification Search ..... 72/334, 72/333, 327; 83/50, 621; 29/20
See application file for complete search history.

(56) References Cited

U.S. PATENT DOCUMENTS

| | | | | | |
|---|---|---|---|---|---|
| 3,728,927 | A | * | 4/1973 | Pfleiderer et al. | 83/621 |
| 4,061,507 | A | * | 12/1977 | Allmendinger | 148/610 |
| 4,590,780 | A | * | 5/1986 | Bachmann | 72/328 |
| 5,144,709 | A | * | 9/1992 | Rooney | 72/335 |
| 5,263,353 | A | * | 11/1993 | Bakermans et al. | 72/334 |
| 6,125,527 | A | * | 10/2000 | Sunaga et al. | 29/558 |
| 6,223,578 | B1 | | 5/2001 | Tadashi | |

FOREIGN PATENT DOCUMENTS

| | | | |
|---|---|---|---|
| JP | 57-4327 | * | 1/1982 |
| JP | 60 006299 | | 5/1985 |
| JP | 60 166128 | | 8/1985 |
| JP | 61-199526 | * | 9/1986 |
| JP | 11 133359 | | 8/1999 |

OTHER PUBLICATIONS

International Search Report for PCT International Application No. PCT/IT2003/000620 mailed Feb. 26, 2004.

* cited by examiner

*Primary Examiner*—Daniel C Crane
(74) *Attorney, Agent, or Firm*—RatnerPrestia

(57) ABSTRACT

A method of processing metal parts and the like by blanking includes the steps of performing a first blanking step on a semi-finished product in order to produce a blanked semi-finished product, and performing a subsequent processing of the blanked semi-finished product to produce a finished product. The first blanking step is performed leaving an allowance on the blanked semi-finished product, and wherein the subsequent processing includes at least one second blanking step by which the allowance is removed from the blanked semifinished product.

7 Claims, 3 Drawing Sheets

METHOD OF PROCESSING METAL PARTS BY BLANKING

This application is a U.S. National Phase Application of PCT International Application PCT/IT2003/000620.

DESCRIPTION

1. Technical Field

The present invention relates to a method of processing metal parts and the like by blanking according to the preamble to main claim 1.

2. Technological Background of the Invention

According to the prior art, the blanking of metal parts in a press, also known as punching, is an operation which brings about the detachment of a portion from a semi-finished product along an outline corresponding to the cross-section of a blanking tool, that is the punch, and of a respective die. The cutting takes place owing to the pressure exerted by the punch during its working stroke on the semi-finished product disposed on the die.

Blanking is widely used in various fields by virtue of the low costs and fast production that are typical of this process. However, it has some disadvantages such as, for example, poor surface finishing of at least a portion of the detachment region. In fact a portion of the surface resulting from blanking has imperfections such as signs of tearing and the like which are not acceptable in the finished product in some cases. Generally, about ⅓ of the surface produced during blanking is cut and the remaining ⅔ is torn so that the part has to be reprocessed by further finishing processes, for example, beveling or polishing, to attenuate the above-mentioned surface imperfections. However, these operations lead to a considerable increase in processing costs.

BRIEF SUMMARY OF THE INVENTION

The problem underlying the present invention is that of providing a method of processing metal parts by blanking that is designed to overcome the limitations discussed above with reference to the prior art mentioned.

This problem is solved by the present invention by means of a method of processing parts by blanking in accordance with the appended claims.

BRIEF DESCRIPTION OF THE DRAWINGS

The characteristics and the advantages of the invention will become clearer from the following detailed description of a preferred embodiment thereof which is described by way of non-limiting example with reference to the appended drawings, in which.

PREFERRED EMBODIMENT OF THE INVENTION

Figure 1:
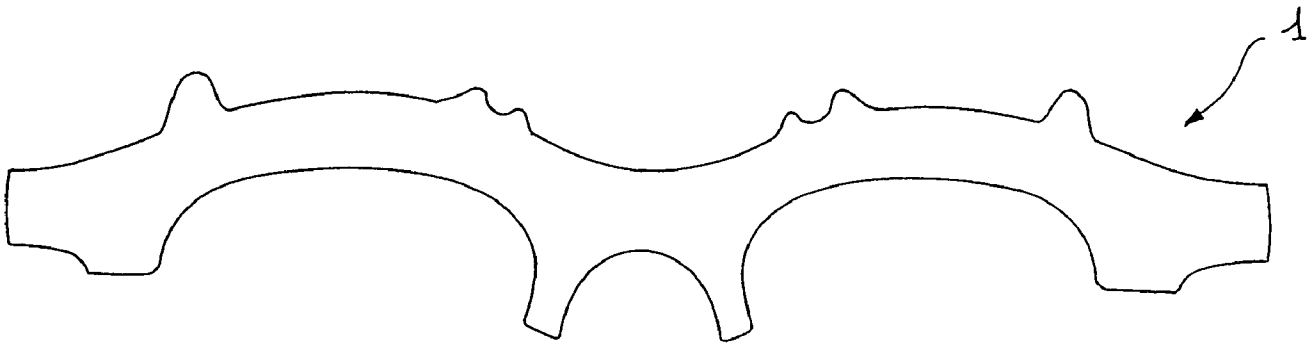
FIG. 1 is a perspective view of a semi-finished metal product to be processed in accordance with the method of the invention.
Figure 2:
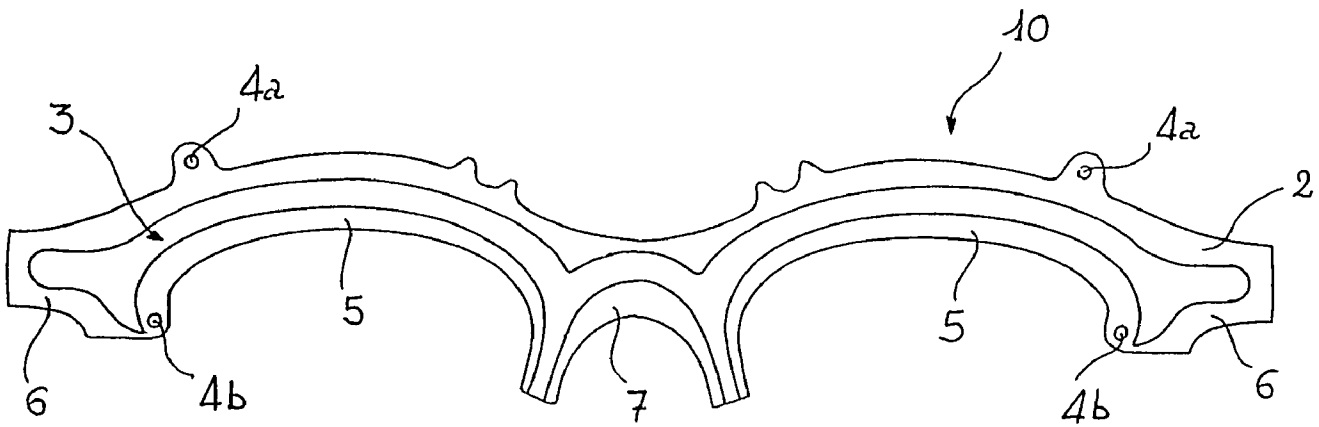
FIG. 2 is a perspective view of the semi-finished product of FIG. 1 after a first processing step.
Figure 4:
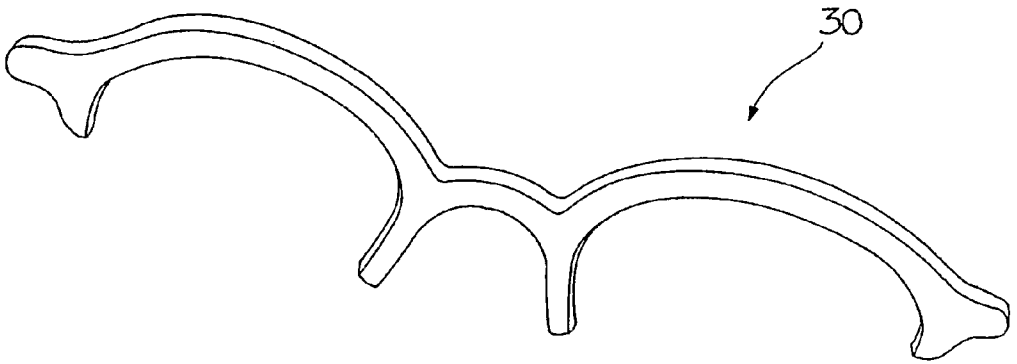
FIG. 4 is a perspective view of the semi-finished product of FIG. 3 after a further processing step.
Figure 3:
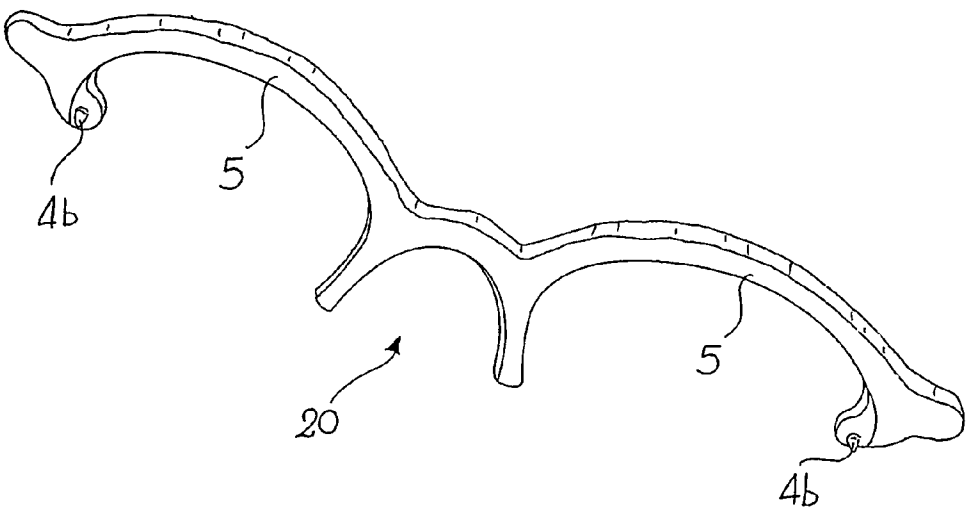
FIG. 3 is a is a perspective view of the semi-finished product of FIG. 2 after a further processing step.
Figure 6:
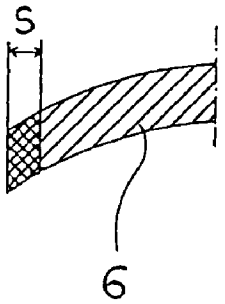
FIG. 6 is a schematic view of a detail of the semi-finished product of FIG. 3, in section and on an enlarged scale.

With reference first of all to FIG. 1, a semi-finished product 1 made of a metal such as, preferably, brass, nickel silver, aluminum, precious metals, or the like, is prepared for processing according to the method of the invention.

The drawings show a semi-finished product for the production of a spectacle frame; however, the method according to the invention is directed towards the processing of semi-finished products irrespective of their final purpose and can therefore be used in various technical fields, such as goldsmithery, precision mechanics, spectacle production, etc.

According to the method of the invention, the semi-finished product 1, which has a predetermined shape produced by conventional blanking or by stamping, is first of all processed by coining to produce a coined semi-finished product 10, on one surface 2 of which an imprint 3 of the shape of the finished product to be produced is coined. The imprint 3 is preferably formed in high relief.

The coined semi-finished product 10 is shaped as a portion of a spectacle frame and, in particular, comprises two upper portions of lens-holding rims 5 connected by a bridge 7, and two shoulders 6.

A plurality of projections is also formed on the surface 2 of the coined semi-finished product 10 by the coining step; in this preferred example, a first and a second pair of appendages 4*a*, 4*b* are formed for locating the coined semi-finished product 10 on a die (not shown) for the subsequent blanking step.

The coined semi-finished product 10 is then subjected to a first blanking step by means of a conventional die and punch, so as to produce a blanked semi-finished product 20 having the characteristics described below.

During this first blanking step, the coined semi-finished product 10 is blanked, leaving an allowance which affects its entire blanking profile or at least the surfaces that are visible in the finished product. In practice, the die and the punch are larger than is necessary for blanking to finished dimensions, by an amount equal to a preselected allowance. According to a principal characteristic of the invention, the thickness S of the allowance is between 0.1 and 1 mm, and preferably between 0.2 and 0.25 mm.

Moreover, during the first blanking step, the first pair 4*a* of locating appendages of the coined semi-finished product 10 is removed.

The surface blanked in this first blanking step, in which the blanked semi-finished product 20 is produced, has the typical imperfections due to blanking; that is, a generally major portion of the thickness bears signs of tearing.

The blanked semi-finished product 20 is then blanked for a second time so as to produce a final product 30 of the desired dimensions. In this second blanking step, the allowance remaining after the first blanking and also the second pair of locating appendages 4*b* are removed.

Surprisingly, it has been found that the number and density of imperfections of the surface of the final product 30 that is involved in the second blanking are greatly reduced in comparison with the semi-finished product 20 produced by the first blanking step so that the blanked surface is homogeneous and substantially free of signs of tearing.

It is pointed out that the second pair of appendages 4*b* is preferably formed in surfaces of the semi-finished product that can be processed further after the second blanking step and/or which are not in view in the finished product; in the example described, which relates to a product that is intended to constitute the front portion of a spectacle frame, the second pair of appendages 4*b* is formed on the inside of the lens-holding rim portions 5. In the region of these projections, the blanked surface portion of the final product 30 bears signs of tearing and more marked imperfections than the remaining surface since it is subjected to a single blanking step, but a chamfering step is subsequently performed on the inside of the lens-holding rim 5 for the fixing of the lenses to the spectacle frame and the surface portion affected by the locating appendages 4*b* is therefore reprocessed.

Figure 5:
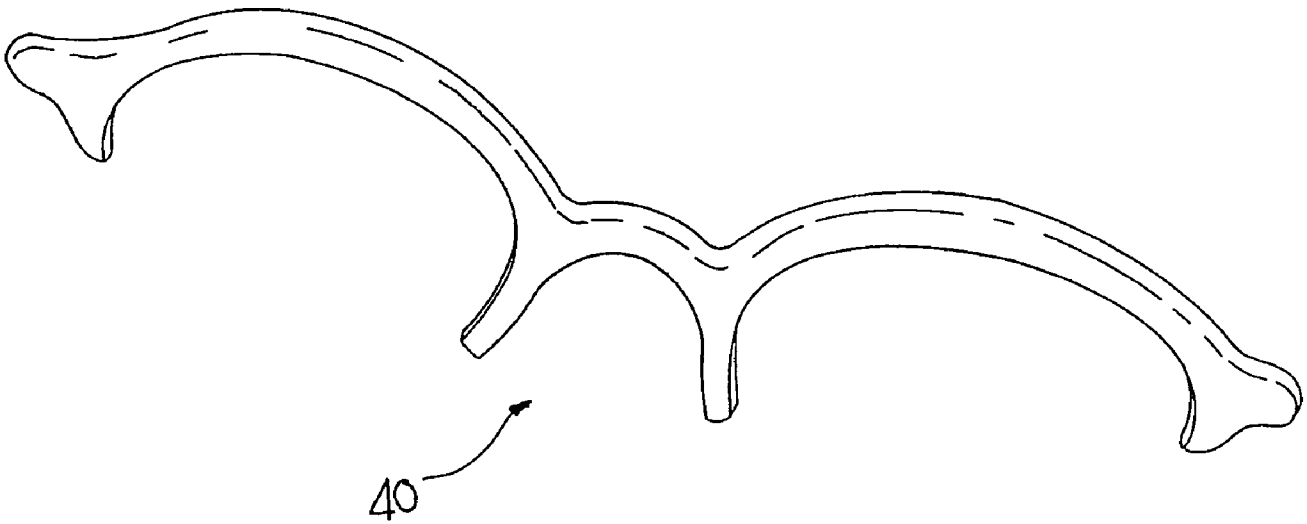
FIG. 5 is a perspective view of the semi-finished product of FIG. 4 after a further processing step.

In order also to remove the remaining irregularities, the final product 30 may be polished, for example, by tumbling until the desired surface uniformity is achieved, as shown, for example, in FIG. 5 in which a final polished product is indicated 40.

The invention thus solves the problem posed, affording many advantages over the prior art mentioned.

A first advantage consists of the fact that, by virtue of the method of the invention, the final product has a surface finish which is considerably improved in comparison with a semi-finished product conventionally blanked only once. In particular, the surface portion which may bear signs of tearing is considerably smaller.

Moreover, the method of the invention permits production with limited costs, lower than those of production by other methods which give an equally homogeneous surface.

The invention claimed is:

1. A method of processing metal parts by blanking, the method comprising the steps of: performing a first blanking step on a semi-finished product in order to produce a blanked semi-finished product, and performing a subsequent processing of the blanked semi-finished product to produce a final product, wherein the first blanking step is performed leaving an allowance on the blanked semi-finished product, and in the subsequent processing comprises at least one second blanking step by which the allowance is removed from the blanked semi-finished product, and prior to the first blanking step, the step of coining of the semi-finished product to produce a coined semi-finished product, and the coined semi-finished product comprises at least a first pair of locating appendages for locating the coined semi-finished product on a die in order to perform the first blanking step, and the coined semi-finished product comprises a second pair of locating appendages, the first pair being removed during the first blanking step and the second pair being removed during the second blanking step.

2. The method according to claim 1 in which the allowance has a thickness of between 0.1 and 1.0 mm.

3. The method according to claim 2 in which the allowance has a thickness of between 0.20 and 0.25 mm.

4. The method according to claim 1 in which the subsequent processing comprises a tumbling step after the second blanking step.

5. A method according to claim 1 in which the second pair of locating appendages is positioned on surfaces of the semi-finished product which are to be processed further after the second blanking step and/or which are not in view upon completion of the processing.

6. The method according to claim 1 in which the final product is a portion of a spectacle frame.

7. The method according to claim 1 in which the metal of the semi-finished product is selected from brass, nickel silver, and aluminum.

* * * * *